US005385491A

United States Patent [19]

Fry

[11] Patent Number: 5,385,491

[45] Date of Patent: Jan. 31, 1995

[54] ELECTRICAL CONNECTOR WITH FLEXIBLE TERMINAL LATCH MEANS AND TERMINAL POSITION ASSURANCE DEVICE

[75] Inventor: Rupert J. Fry, Des Plaines, Ill.

[73] Assignee: Molex Incorporated, Lisle, Ill.

[21] Appl. No.: 171,145

[22] Filed: Dec. 21, 1993

[51] Int. Cl.[6] ..... H01R 13/426

[52] U.S. Cl. ..... 439/595; 439/752

[58] Field of Search ..... 439/744, 752, 595, 603

[56] References Cited

U.S. PATENT DOCUMENTS

| | | | |
|---|---|---|---|
| 4,343,523 | 8/1982 | Cairns et al. | 339/59 M |
| 4,714,437 | 12/1987 | Dyki | 439/595 |
| 4,749,372 | 6/1988 | Betsui | 439/587 |
| 4,820,198 | 4/1989 | Lulko et al. | 439/595 |
| 4,944,695 | 7/1990 | Tsuji et al. | 439/595 |
| 4,944,696 | 7/1990 | Sueyoshi et al. | 439/595 |
| 5,085,598 | 2/1992 | Kinoshita | 439/595 |
| 5,100,346 | 3/1992 | McCardell | 439/595 |
| 5,160,279 | 11/1992 | Sagawa et al. | 439/595 |
| 5,176,537 | 1/1993 | Samejima et al. | 439/595 |
| 5,328,382 | 7/1994 | Pawucki | 439/595 X |

*Primary Examiner*—Eugene F. Desmond
*Attorney, Agent, or Firm*—Stephen Z. Weiss

[57] ABSTRACT

An electrical connector includes a dielectric housing defining at least one elongated terminal-receiving passageway with at least one flexible latch wall extending longitudinally of the passageway. A terminal is adapted to be inserted into the passageway. The terminal has a longitudinal axis, a side wall in proximity to the flexible latch wall and a mating portion adapted to mate with a complementary terminal inserted into the passageway. Complementary interengaging primary latches are provided between the side wall of the terminal and the flexible latch wall of the housing for holding the terminal in the passageway. A terminal position assurance device is mountable in the housing for movement between first and second positions only when the terminal is properly positioned in the passageway. The terminal position assurance device engages the outside of the flexible latch wall of the housing and the inside of the side wall of the terminal to prevent lateral separation of the walls and disengagement of the primary latches and, thereby, provide a secondary latch for the terminal.

10 Claims, 4 Drawing Sheets

ELECTRICAL CONNECTOR WITH FLEXIBLE TERMINAL LATCH MEANS AND TERMINAL POSITION ASSURANCE DEVICE

FIELD OF THE INVENTION

This invention generally relates to the art of electrical connectors and, particularly, to an electrical connector which includes a terminal position assurance device.

BACKGROUND OF THE INVENTION

Terminal position assurance devices are known for use in electrical connectors to assure that the terminals in the connector are properly positioned within the connector housing. Basically, a terminal position assurance device is movable between a first position and a second position. The device can move to the second position only when the terminal or terminals are properly positioned in their respective passages in the housing. If a terminal is not properly positioned, the terminal position assurance device cannot move to its second position. Such a device often is used to prevent mating of a connector with a complementary connector unless the terminal position assurance device(s) is moved to its second or enabling position.

In addition, various types of terminal latch means are provided to hold the terminals in the passageways against withdrawal therefrom. Basically, some form of flexible latch bosses, shoulders or the like snappingly interengage when a terminal is fully or properly positioned in its respective passageway in the connector housing. This type of latch means often is called the primary latch means for the terminals of the connector. In some connector constructions, secondary latch means are provided to prevent disengagement of the primary latch means.

This invention is directed to an electrical connector having a terminal position assurance device which also serves as a secondary latch means, particularly for use in an electrical connector in which a flexible wall of the connector housing provides part of the primary latch means for a terminal.

SUMMARY OF THE INVENTION

An object, therefore, of the invention is to provide a new and improved electrical connector with a terminal position assurance device of the character described.

In the exemplary embodiment of the invention, the electrical connector includes a dielectric housing defining at least one elongated terminal-receiving passageway with at least one flexible latch wall extending longitudinally of the passageway. A terminal is adapted to be inserted into the passageway. The terminal has a longitudinal axis, a side wall in proximity to the flexible latch wall of the housing and a mating portion adapted to mate with a complementary terminal means inserted into the passageway. Complementary interengaging primary latch means are provided between the side wall of the terminal and the flexible latch wall of the housing for holding the terminal in the terminal-receiving passageway.

The invention contemplates the provision of a terminal position assurance device mountable in the housing for movement between first and second positions only when the terminal is properly positioned in the passageway. The terminal position assurance device includes restriction means for engaging the outside of the flexible latch wall of the housing and the inside of the side wall of the terminal to prevent lateral separation of the walls and disengagement of the primary latch means and, thereby, provide a secondary latch means for the terminal.

As disclosed herein, the primary latch means include a laterally projecting latch boss on the flexible latch wall of the housing and a latch shoulder on the terminal for snapping behind the latch boss to prevent removal of the terminal from the passageway. The passageway and the terminal position assurance device are relatively sized and configured such that the terminal position assurance device is adapted to be inserted longitudinally into the passageway.

The invention is illustrated in an electrical connector wherein the housing has a pair of the flexible latch walls extending along opposite sides of each terminal-receiving passageway. The terminal includes a generally U-shaped portion defining a pair of side walls in respective proximity to the flexible latch walls. Primary latch means are provided between each latch wall and the respective side wall. The flexible latch walls have free longitudinal edges, and the side walls of the terminals have free longitudinal edges generally parallel to the free longitudinal edges of the latch walls. The terminal position assurance device includes a pair of channels for capturing the pairs of walls therewithin and preventing lateral separation of the walls.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
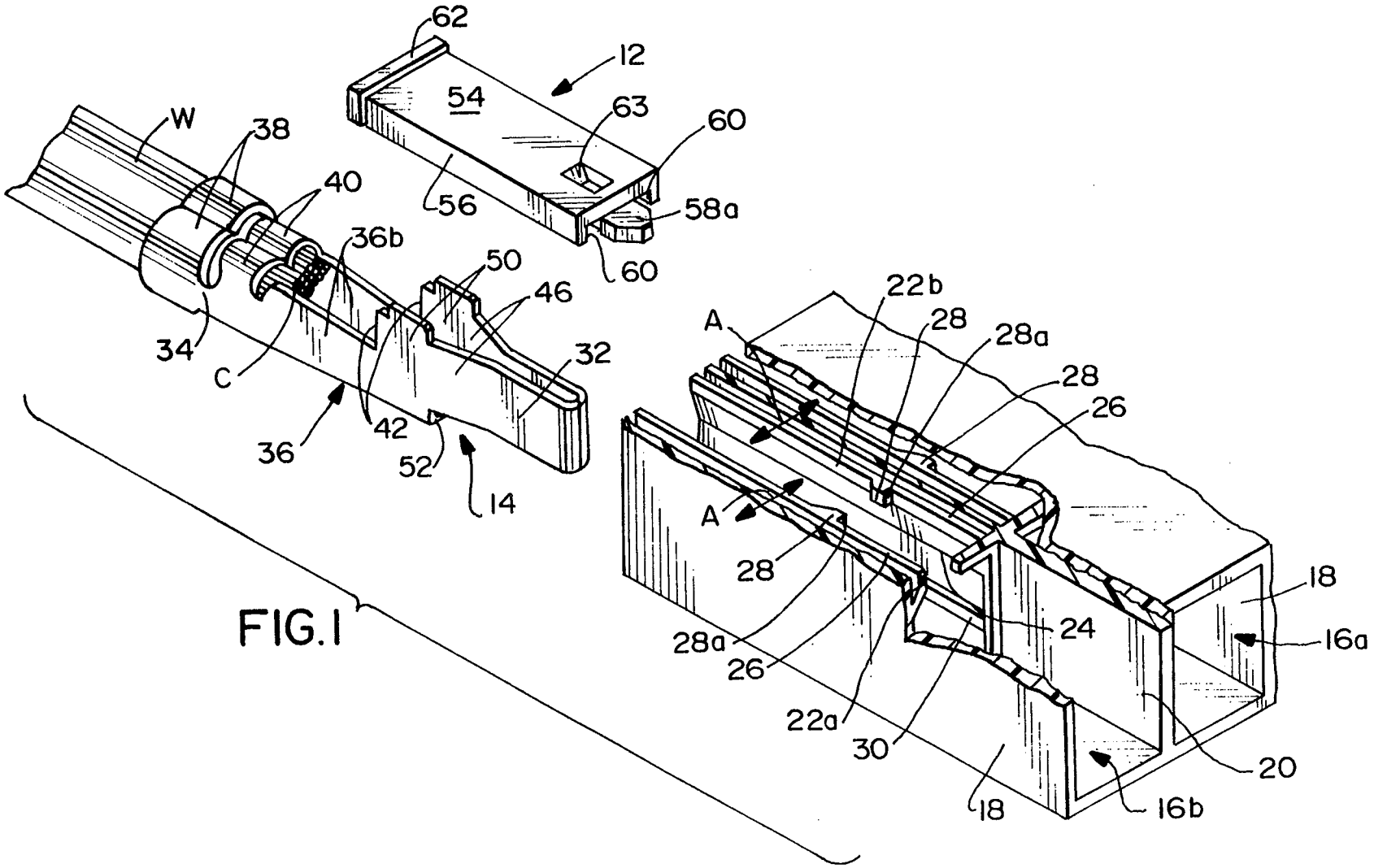
FIG. 1 is a perspective view, partially cut away to show the interior of a connector housing having two terminal-receiving passageways, along with one of the terminals, and incorporating the terminal position assurance device of the invention.

Generally, and referring to the drawings in greater detail, FIG. 1 shows a two-passageway connector housing, generally designated 10. The housing is adapted for receiving a pair of electrical terminals, generally designated 14 in FIGS. 1, 3 and 4. The invention contemplates a terminal position assurance device, generally designated 12, shown in FIGS. 1 and 5–10.

More particularly, referring to FIG. 1, dielectric housing 10 includes generally rigid wall means defining a pair of elongated terminal-receiving passageways indicated generally at 16*a* and 16*b*. The generally rigid wall means include a pair of outside walls 18 and a center wall or partition 20. A plurality of latch walls 22*a* and 22*b* are disposed within and extend longitudinally of each terminal-receiving passageway 16*a* and 16*b*. Specifically, outside latch wall 22*a* and inside latch wall 22*b* are disposed on opposite sides of each passageway.

Dielectric connector housing 10, including its generally rigid wall means 18 and 20, along with latch walls 22*a* and 22*b*, is unitarily molded of plastic material. It can be seen that each latch wall 22*a* and 22*b* is elongated and defines opposite longitudinal edges 24 and 26. Edges 24 are joined to the respective walls 18 and 20. Edges 26 are free and project into the respective terminal-receiving passageways for transverse flexing about joined edges 24 in the direction of double-headed arrows "A". In essence, with the housing unitarily molded of dielectric plastic material, "joining" edges 24 define elongated living hinges for flexing of the latch walls transversely of the longitudinal axes of terminal-receiving passageways 16*a* and 16*b*. Lastly, each latch wall 22*a* and 22*b* of connector housing 10 in FIG. 1 includes a latch boss 28 defining a latch shoulder 28*a* for purposes described hereinafter. The latch bosses project into the terminal-receiving passageways.

Figure 2:
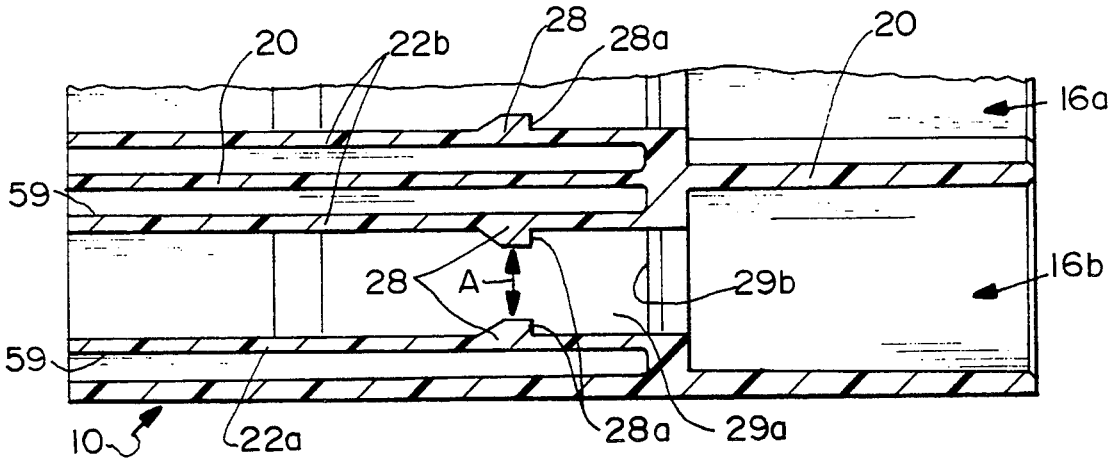
FIG. 2 is a horizontal axial section through the connector housing in the area of one of the terminal-receiving passageways.

Turning next to FIG. 2, each terminal-receiving passageway includes a lower cavity wall portion 29*a* and a stop shoulder 29*b*. FIG. 2 best shows the shape of latch bosses 28 and latch shoulders 28*a*. The flexing direction of the latch walls is indicated by double-headed arrow "A".

Figure 3:
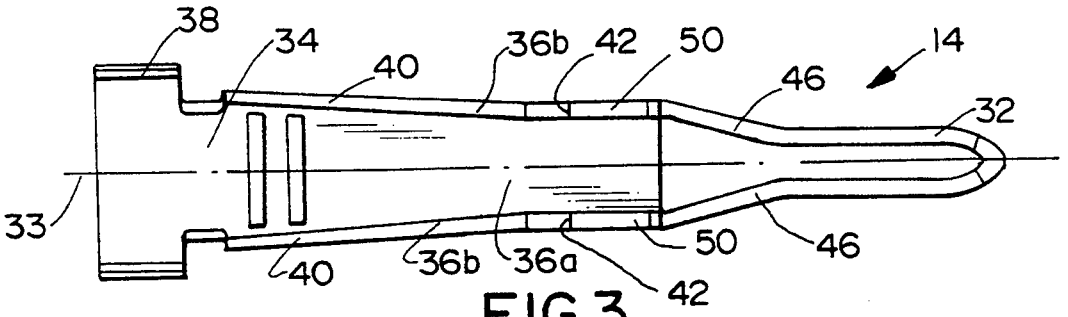
FIG. 3 is a top plan view of a terminal for insertion into one of the passageways in the housing.

Referring now to FIGS. 1 and 3, each terminal 14 is elongated and is stamped and formed from sheet metal material. The terminal defines a longitudinal axis 33. The terminal includes a front blade-like male mating end 32, a rear terminating end 34 and an intermediate body portion 36 between the ends. Terminating end 34 includes two pairs of crimp arms 38 and 40, crimp arms 38 being adapted for crimping onto the outside insulation or cladding of an insulated electrical wire "W" (FIG. 1), and crimp arms 40 being adapted for crimping onto and terminating the electrical conductive core "C" of the wire, all of which is well known in the art. Lastly, intermediate body portion 36 is generally U-shaped to define a bottom wall 36*a* and a pair of side walls 36*b*. Each side wall has a latch shoulder 42 stamped in the upper edge thereof. Therefore, the remainder of side walls 36*b* and bottom wall 36*a* provide a substantial massive body portion of the terminal of excellent current flow characteristics.

Figure 4:
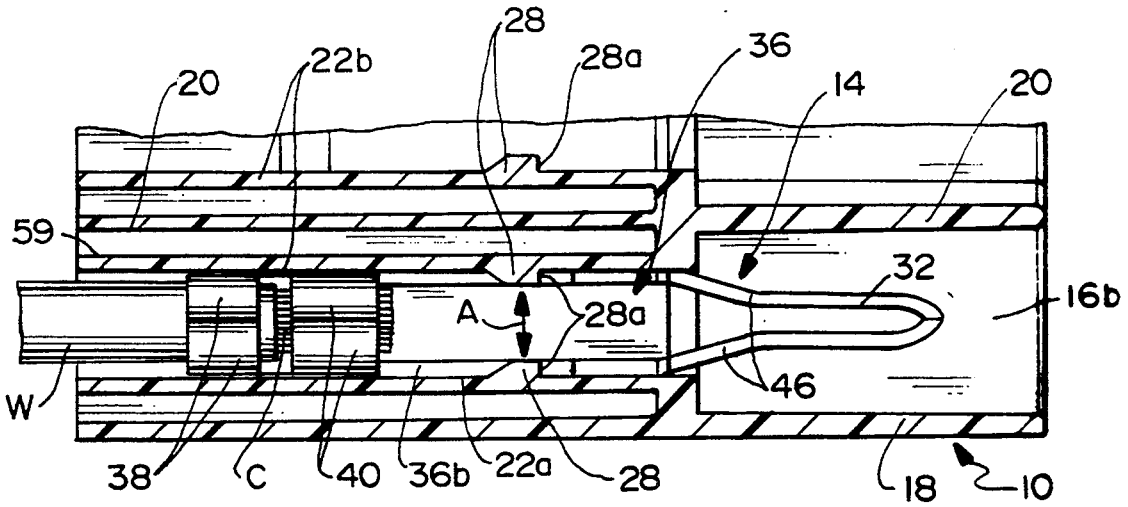
FIG. 4 is a view similar to that of FIG. 2, with one of the terminals inserted into the passageway of the housing.
Figure 8:
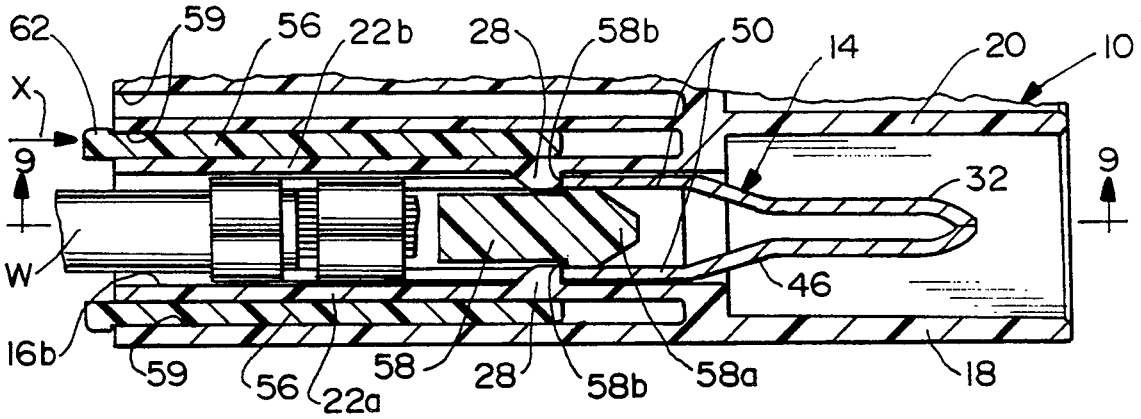
FIG. 8 is a view similar to that of FIG. 4, with the terminal position assurance device inserted into the passageway.

The insertion of one of the terminals 14 into one of the passageways in connector housing 10, and the operation of the latching system of the invention, now will be described in relation to FIG. 4 which shows a terminal 14 inserted into passageway 16*b* of connector housing 10. Specifically, terminal 14 is inserted into passageway 16*b* of housing 10 in the direction of arrow "B". It can be seen that front male end 32 of the terminal is narrower than body portion 36 and is joined thereto by a tapered transition section 46. As the terminal is inserted into the passageway, the tapered transition section engages the rear sides of latch bosses 28 which, themselves, are tapered as seen in FIGS. 2 and 8. As the terminal is inserted further into the passageway, latch bosses 28 of latch walls 22*a* and 22*b* will engage side walls 36*b* of the intermediate body portion 36 of the terminal, whereupon the latch walls will flex transversely outwardly of the longitudinal axis of the terminal and passageway. In essence, latch walls 22*a* and 22*b* will flex outwardly about their living hinges defined by edges 24 integrally joined to the generally rigid wall means 18 and 20 of the housing.

When the terminal reaches its fully inserted position, with front male end 32 positioned forwardly in passageway 16*b* for mating with a complementary female terminal inserted into the passageway, flexible latch walls 22*a* and 22*b* will snap back inwardly as latch shoulders 42 on the terminal pass latch shoulders 28*a* of latch bosses 28 on the flexible latch walls. The forwardly facing latch shoulders 28*a* of the housing latch walls and the rearwardly facing latch shoulders 42 of the terminal prevent removal of the terminal from passageway 16*c*. When fully inserted, the tops of a pair of tangs 50 of terminal 14 engage the upper cavity wall, bottom wall 36*a* of the terminal engages lower cavity wall portion 29*a* and a forwardly facing shoulder 52 of the terminal engages stop shoulder 29*b*.

Figure 5:
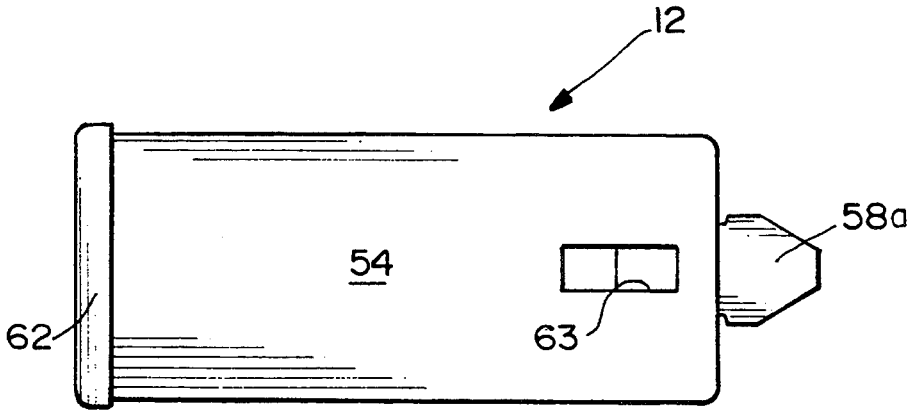
FIG. 5 is a top plan view of the terminal position assurance device.
Figure 6:
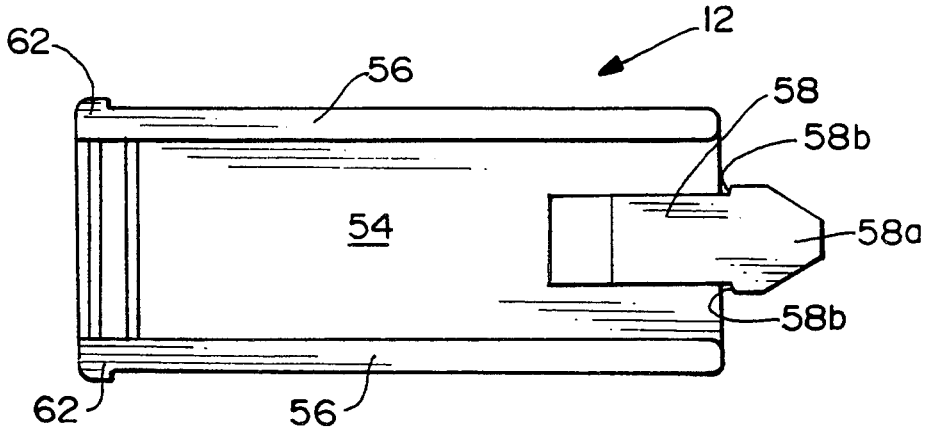
FIG. 6 is a bottom plan view of the terminal position assurance device.
Figure 7:
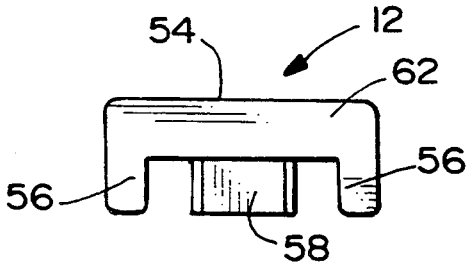
FIG. 7 is an end elevational view of the terminal position assurance device.

Terminal position assurance device 12 (FIG. 1), shown in detail in FIGS. 5–7, is mountable in the housing 10 for movement between first and second positions only when the terminal 14 is properly positioned in the passageway. More particularly, the device includes a generally planar, rectangular top wall 54 having a pair of longitudinal side walls or flanges 56 depending therefrom on opposite sides or edges thereof. A boss 58 depends from the underside of top wall 54 generally at the center thereof and includes a forwardly projecting head portion 58*a*. Forwardly projecting head portion 58*a* has laterally extending lock shoulders 58*b* adapted to lock behind housing wall latch shoulders 28*a* when the terminal position assurance device 12 is fully inserted in the housing 10 in the second position preventing the device from being inadvertently removed from the housing.

Side walls 56 and boss 58 define channels 60 therebetween on opposite sides of the boss. Lastly, a lip 62 projects slightly outwardly of the device at an end thereof, for purposes described below. The device is molded of rigid dielectric material such as plastic or the like. Hole 63 in top wall 54 simply is a molding core-out hole.

Figure 9:
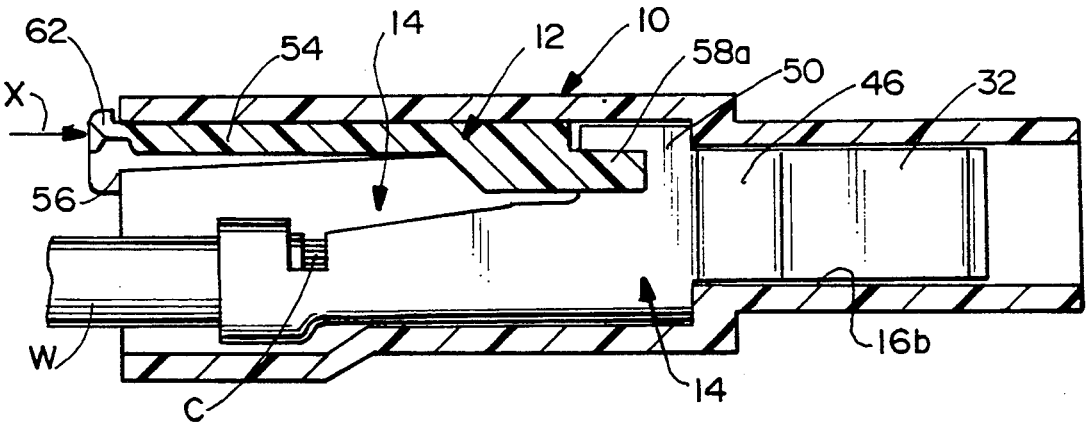
FIG. 9 is a vertical section taken generally along line 9—9 of FIG. 8.
Figure 10:
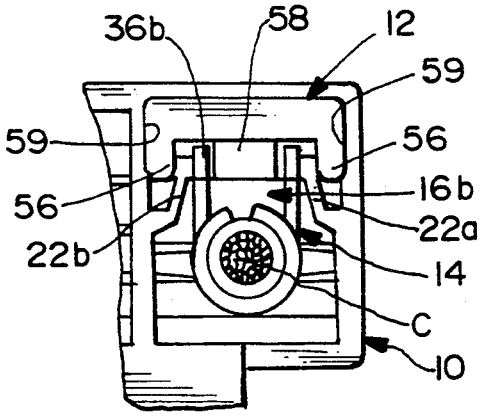
FIG. 10 is an end elevational view looking into the passageway from the right-hand end of FIG. 9.

In operation of terminal position assurance device 12, reference is made to FIGS. 8–10, wherein it can be seen that the terminal position assurance device has been inserted into the rear of passageway 16*b* in the direction of arrow "X" (FIGS. 8 and 9). When so inserted, side walls 56 of the terminal position assurance device slide in slots 59 (FIG. 8) between generally rigid walls 18 of housing 10 and flexible latch walls 22*a* and 22*b* of the housing. As best seen in FIG. 8, side walls 56 of the terminal position assurance device are positioned immediately outside the flexible latch walls whereby the latch walls cannot move laterally outwardly away from their latched condition with terminal 14.

When terminal position assurance device is moved to the second position shown in FIGS. 8–10, it also can be seen particularly in FIG. 8, that boss 58 is positioned between and in engagement with latch bosses 28, and head portion 58*a* of the boss is positioned between and in engagement with tangs 50 of terminal 14 to prevent lateral movement inwardly of side walls 36*b* of the terminal. Therefore, latch shoulders 42 of the terminal cannot move laterally inwardly away from their latched engagement with latch bosses 28 of flexible latch walls 22*a* and 22*b*. In essence, channels 60 (FIGS. 6 and 7) between side walls 56 and boss 58/head portion 58*a* are effective to sandwich the flexible latch walls of the housing and the side walls of the terminal within the channels so that the walls cannot separate and disengage the latch bosses and latch shoulders. It can also be seen in FIGS. 8 and 9 that lip 62 at the rear end of the terminal position assurance device engages the outside of housing 10 about the periphery or mouth of passageway 16*b* to prevent over-insertion of the terminal position assurance device beyond its proper position as shown. Lastly, laterally extending lock shoulders 58*b* lock behind housing wall latch shoulders 28*a* to prevent the device from being inadvertently removed from the housing.

If terminal 14 is not fully inserted into passageway 16*b* (i.e. latch shoulders 42 of the terminal have not snapped behind latch shoulders 28*a* of latch bosses 28), head portion 58*a* of boss 58 of terminal position assurance device 12 cannot pass between the latch bosses because of the thicknesses of tangs 50 of the terminal. In other words, channels 60 of the terminal position assurance device are too narrow to accept the combined thickness of the flexible latch walls, latch bosses and the metal of the terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector which includes a dielectric housing defining at least one elongated terminal-receiving passageway with at least one flexible latch wall extending longitudinally of the passageway, a terminal adapted to be inserted into the passageway, the terminal having a longitudinal axis, a side wall in proximity to said flexible latch wall and a mating portion adapted to mate with a complementary terminal means inserted into the passageway, and complementary interengaging primary latch means between the side wall of the terminal and said flexible latch wall for holding the terminal in the terminal-receiving passageway, wherein the improvement comprises:

a terminal position assurance device mountable in the housing for movement between first and second positions only when the terminal is properly positioned in the passageway, the terminal position assurance device including restriction means for engaging the outside of the flexible latch wall of the housing and the inside of the side wall of the terminal to prevent lateral separation of the walls and disengagement of said primary latch means and, thereby, provide a secondary latch means for the terminal.

2. In an electrical connector as set forth in claim 1, wherein said primary latch means comprise a laterally projecting latch boss on the flexible latch wall of the housing and a latch shoulder on the terminal for snapping behind the latch boss to prevent removal of the terminal from the passageway.

3. In an electrical connector as set forth in claim 1, including a pair of said flexible latch walls extending along opposite sides of the terminal-receiving passageway, a pair of said side walls of the terminal in respective proximity to the latch walls, primary latch means between each latch wall and the respective side wall, and the terminal position assurance device including restriction means for preventing lateral separation of both of the flexible latch walls from their respective terminal side walls and disengagement of the respective primary latch means.

4. In an electrical connector as set forth in claim 3, wherein said terminal includes a generally U-shaped portion defining said pair of side walls thereof.

5. In an electrical connector as set forth in claim 1, wherein said flexible latch wall of the housing has a free longitudinal edge, the side wall of the terminal has a free longitudinal edge generally parallel to the free longitudinal edge of the flexible latch wall, and the terminal position assurance device includes a channel for capturing the flexible latch walls and the terminal side wall therewithin and preventing lateral separation of the walls.

6. In an electrical connector as set forth in claim 1, including a pair of said flexible latch walls extending along opposite sides of the terminal-receiving passageway, each flexible latch wall having a free longitudinal edge, a pair of said side walls of the terminal in respective proximity to the flexible latch walls, each side wall having a free longitudinal edge generally parallel to the free longitudinal edge of a respective one of the flexible latch walls, primary latch means between each latch wall and the respective side wall, and the terminal position assurance device includes a pair of channels for capturing each flexible latch wall and the respective side wall therewithin and preventing lateral separation of the walls.

7. In an electrical connector as set forth in claim 6, wherein said terminal position assurance device includes a pair of longitudinal walls and a boss portion therebetween, the longitudinal walls and the boss portion defining said channels.

8. In an electrical connector as set forth in claim 7, wherein said terminal includes a generally U-shaped portion defining said pair of side walls thereof, and the boss portion of the terminal position assurance device is insertable between the side walls of the terminal with the longitudinal walls of the device being positioned outside the flexible latch walls of the housing.

9. In an electrical connector as set forth in claim 8, wherein said boss portion of the terminal position assurance device includes laterally extending lock shoulders adapted to lock behind housing wall latch shoulders when the terminal position assurance device is fully inserted in the second position in the housing preventing its removal therefrom.

10. In an electrical connector which includes a dielectric housing defining at least one elongated terminal-receiving passageway with at least one flexible latch wall extending longitudinally of the passageway, a terminal adapted to be inserted into the passageway, the terminal having a side wall in proximity to said flexible latch wall, complementary interengaging primary latch means between the side wall of the terminal and said flexible latch wall for holding the terminal in the terminal-receiving passageway, wherein the improvement comprises:

a terminal position assurance device insertable generally parallel to the passageway and. engageable with the flexible latch wall of the housing and an inside portion of said side wall of the terminal to prevent lateral separation thereof and disengagement of the primary latch means and, thereby, provide a secondary latch means for the terminal.

* * * * *